US011273613B2

(12) United States Patent
Kachkovsky et al.

(10) Patent No.: US 11,273,613 B2
(45) **Date of Patent: *Mar. 15, 2022**

(54) TRASH COMPACTOR

(71) Applicant: Compaction Technologies, Inc., Brooklyn Park, MN (US)

(72) Inventors: Alexander Kachkovsky, Plymouth, MN (US); Kenneth Judge, Oakdale, MN (US)

(73) Assignee: Compaction Technologies, Inc., Eagan, MN (US)

( * ) Notice: Subject to any disclaimer, the term of this patent is extended or adjusted under 35 U.S.C. 154(b) by 51 days.

This patent is subject to a terminal disclaimer.

(21) Appl. No.: 16/796,038

(22) Filed: Feb. 20, 2020

(65) Prior Publication Data

US 2021/0053308 A1 Feb. 25, 2021

Related U.S. Application Data

(63) Continuation of application No. 16/026,189, filed on Jul. 3, 2018, now Pat. No. 10,596,775, which is a (Continued)

(51) Int. Cl.
*B30B 1/10* (2006.01)
*B30B 1/16* (2006.01)
(Continued)

(52) U.S. Cl.
CPC ..... *B30B 1/10* (2013.01); *B30B 1/02* (2013.01); *B30B 1/103* (2013.01); *B30B 1/16* (2013.01);
(Continued)

(58) Field of Classification Search
CPC .... B30B 1/02; B30B 1/06; B30B 1/10; B30B 1/14; B30B 1/16; B30B 9/3032;
(Continued)

(56) References Cited

U.S. PATENT DOCUMENTS 184,931 A 11/1876 Unbehend
364,995 A 6/1887 Drew
(Continued)

FOREIGN PATENT DOCUMENTS

EP 0941948 A1 9/1999
GB 424591 A * 2/1935 ..... B30B 1/02
(Continued)

OTHER PUBLICATIONS

"U.S. Appl. No. 12/144,235, Non Final Office Action dated Jul. 19, 2010", 12 pgs.
(Continued)

*Primary Examiner* — Jimmy T Nguyen
(74) *Attorney, Agent, or Firm* — Schwegman Lundberg & Woessner, P.A.

(57) ABSTRACT

A trash compactor may include a frame, a cavity, a trash receptacle, a platen movable to compress trash collected in the trash receptacle, a set of linkages and a drive mechanism configured to drive said platen up and down, the drive mechanism further configured as one of the link elements, and a platen guide mechanism configured to restrict the motion of the platen in an up and down manner.

4 Claims, 17 Drawing Sheets

Related U.S. Application Data continuation of application No. 14/560,576, filed on Dec. 4, 2014, now Pat. No. 10,029,434, which is a continuation-in-part of application No. 13/091,004, filed on Apr. 20, 2011, now abandoned, which is a continuation-in-part of application No. 12/144,235, filed on Jun. 23, 2008, now Pat. No. 7,950,325.

(51) Int. Cl.

| | |
|---|---|
| ***B30B 9/30*** | (2006.01) |
| ***B30B 1/02*** | (2006.01) |
| ***B65F 1/14*** | (2006.01) |
| ***B65F 1/16*** | (2006.01) |

(52) U.S. Cl.

CPC ..... *B30B 9/306* (2013.01); *B30B 9/3032* (2013.01); *B30B 9/3042* (2013.01); *B30B 9/3057* (2013.01); *B65F 1/1405* (2013.01); *B65F 1/1426* (2013.01); *B65F 1/1623* (2013.01); *B65F 1/1638* (2013.01); *B65F 2210/148* (2013.01); *B65F 2210/168* (2013.01)

(58) Field of Classification Search

CPC ..... B30B 9/306; B30B 9/3057; B30B 9/3042; B30B 15/041; B65F 1/1405; B65F 1/1426; B65F 1/1623; B65F 1/1638; B65F 2210/148; B65F 2210/168

USPC ... 100/215, 229 A, 280, 281, 282, 283, 285, 100/286, 287, 289, 295

See application file for complete search history.

(56) References Cited

U.S. PATENT DOCUMENTS

| | | | |
|---|---|---|---|
| 716,359 | A | 12/1902 | Allen |
| 2,932,063 | A | 4/1960 | Belden et al. |
| 3,447,447 | A | 6/1969 | Rutty |
| 3,527,161 | A | 9/1970 | Brown et al. |
| 3,714,890 | A | 2/1973 | Moon |
| 3,728,959 | A | 4/1973 | Fredrickson |
| 3,772,984 | A | 11/1973 | Karls et al. |
| 3,817,170 | A | 6/1974 | Mayer |
| 3,842,729 | A | 10/1974 | Mandrup |
| 3,859,908 | A | 1/1975 | Karls et al. |
| 3,892,142 | A | 7/1975 | Karls et al. |
| 3,937,355 | A | 2/1976 | Engebretsen |
| 3,960,071 | A | 6/1976 | Mayer et al. |
| 3,979,008 | A | 9/1976 | Weeks et al. |
| 4,018,148 | A | 4/1977 | Wolbrink |
| 4,024,806 | A | 5/1977 | Weeks et al. |
| 4,041,856 | A | 8/1977 | Fox |
| 4,064,798 | A | 12/1977 | Wolbrink et al. |
| 4,080,889 | A | 3/1978 | Shiloni |
| 4,096,421 | A | 6/1978 | Farber et al. |
| 4,100,850 | A | 7/1978 | Wolbrink et al. |
| 4,130,054 | A | 12/1978 | Tashman |
| 4,188,872 | A | 2/1980 | Chrablow |
| 4,213,387 | A | 7/1980 | McCaney et al. |
| 4,302,961 | A | 12/1981 | Leinhaas |
| 4,369,700 | A | 1/1983 | Flagg |
| 4,444,099 | A | 4/1984 | Paleschuck |
| 4,453,455 | A | 6/1984 | Bergstrand |
| 4,548,132 | A | 10/1985 | Moon |
| 4,552,061 | A | 11/1985 | Brutsman |
| 4,565,125 | A | 1/1986 | Khan |
| 4,638,730 | A | 1/1987 | Bonacorsi |
| 4,715,498 | A | 12/1987 | Hanifl |
| 4,914,340 | A | 4/1990 | Fox |
| 5,007,814 | A | 4/1991 | Saunders et al. |
| 5,042,374 | A | 8/1991 | Klepacki |
| 5,137,212 | A | 8/1992 | Fiterman et al. |
| 5,465,660 | A | 11/1995 | Conti et al. |
| 5,517,907 | A | 5/1996 | Fox |
| 5,645,172 | A | 7/1997 | Shantzis |
| 5,690,025 | A | 11/1997 | Hawkins |
| 5,695,114 | A | 12/1997 | Evans |
| 5,823,087 | A | 10/1998 | Eigenmann |
| 6,012,370 | A | 1/2000 | Kobayashi |
| 6,367,377 | B1 | 4/2002 | Gawley et al. |
| 6,481,467 | B2 | 11/2002 | Czebatol et al. |
| 6,578,762 | B1 | 6/2003 | Knappmiller |
| 6,701,832 | B1 | 3/2004 | Hawkins |
| 7,007,598 | B1 | 3/2006 | Patras |
| 7,950,325 | B2 | 5/2011 | Kachkovsky et al. |
| 8,683,920 | B1 | 4/2014 | Oropeza |
| 10,029,434 | B2 | 7/2018 | Hitchcock et al. |
| 10,596,775 | B2 | 3/2020 | Kachkovsky et al. |
| 2004/0168502 | A1 | 9/2004 | Schulte |
| 2004/0250711 | A1 | 12/2004 | Ernst |
| 2005/0005785 | A1 | 1/2005 | Poss et al. |
| 2006/0156933 | A1 | 7/2006 | Hofele et al. |
| 2007/0289967 | A1 | 12/2007 | Pierce et al. |
| 2009/0145309 | A1 | 6/2009 | Fox |
| 2009/0314169 | A1 | 12/2009 | Kachkovsky |
| 2011/0041711 | A1 | 2/2011 | Nickell-Lean |
| 2011/0056393 | A1 | 3/2011 | Kachkovsky |
| 2011/0174170 | A1 | 7/2011 | Fritz et al. |
| 2011/0192293 | A1 | 8/2011 | Hitchcock et al. |
| 2013/0220150 | A1 | 8/2013 | Preen et al. |
| 2014/0025589 | A1 | 1/2014 | Yang |
| 2014/0041538 | A1 | 2/2014 | Parmar |
| 2015/0101499 | A1 | 4/2015 | Hitchcock et al. |
| 2015/0246497 | A1 | 9/2015 | Papadopoulos |
| 2016/0130082 | A1 | 5/2016 | Gwon et al. |
| 2017/0197783 | A1 | 7/2017 | Lundquist et al. |
| 2017/0215980 | A1 | 8/2017 | Debusk et al. |
| 2017/0362027 | A1 | 12/2017 | Traber et al. |
| 2018/0311921 | A1 | 11/2018 | Hitchcock et al. |

FOREIGN PATENT DOCUMENTS

| | | | |
|---|---|---|---|
| JP | H03227801 | A | 10/1991 |
| RU | 201844901 | | 8/1994 |
| WO | WO-2012145579 | A1 | 10/2012 |

OTHER PUBLICATIONS

"U.S. Appl. No. 12/144,235, Notice of Allowance dated Jan. 25, 2011", 7 pgs.

"U.S. Appl. No. 12/144,235, Response filed Nov. 19, 2010 to Non Final Office Action dated Jul. 19, 2010", 8 pgs.

"U.S. Appl. No. 13/091,004, Advisory Action dated Feb. 22, 2012", 3 pgs.

"U.S. Appl. No. 13/091,004, Advisory Action dated Aug. 9, 2013", 2 pgs.

"U.S. Appl. No. 13/091,004, Advisory Action dated Aug. 15, 2014", 3 pgs.

"U.S. Appl. No. 13/091,004, Examiner Interview Summary dated Mar. 12, 2013", 3 pgs.

"U.S. Appl. No. 13/091,004, Final Office Action dated Jun. 4, 2014", 14 pgs.

"U.S. Appl. No. 13/091,004, Final Office Action dated Jun. 7, 2013", 8 pgs.

"U.S. Appl. No. 13/091,004, Final Office Action dated Dec. 20, 2011", 9 pgs.

"U.S. Appl. No. 13/091,004, Non Final Office Action dated Aug. 2, 2011", 11 pgs.

"U.S. Appl. No. 13/091,004, Non Final Office Action dated Nov. 25, 2013", 10 pgs.

"U.S. Appl. No. 13/091,004, Non Final Office Action dated Dec. 17, 2012", 7 pgs.

"U.S. Appl. No. 13/091,004, Notice of Non-Compliant Amendment dated Apr. 23, 2012", 2 pgs.

"U.S. Appl. No. 13/091,004, Response filed Feb. 20, 2012 to Final Office Action dated Dec. 20, 2011", 12 pgs.

"U.S. Appl. No. 13/091,004, Response filed Feb. 22, 2014 to Non Final Office Action dated Nov. 25, 2013", 16 pgs.

(56) References Cited

OTHER PUBLICATIONS

"U.S. Appl. No. 13/091,004, Response filed Mar. 15, 2013 to Non Final Office Action dated Dec. 17, 2012", 2 pgs.
"U.S. Appl. No. 13/091,004, Response filed Jun. 22, 2012 to Notice of Non-Compliant Amendment dated Apr. 23, 2012", 2 pgs.
"U.S. Appl. No. 13/091,004, Response filed Aug. 1, 2013 to Final Office Action dated Jun. 7, 2013", 5 pgs.
"U.S. Appl. No. 13/091,004, Response filed Aug. 4, 2014 to Final Office Action dated Jun. 4, 2014", 15 pgs.
"U.S. Appl. No. 13/091,004, Response filed Dec. 2, 2011 to Non Final Office Action dated Aug. 2, 2011", 14 pgs.
"U.S. Appl. No. 14/560,576, 312 Amendment filed Apr. 18, 2018", 37 pgs.
"U.S. Appl. No. 14/560,576, Examiner Interview Summary dated Feb. 13, 2018", 2 pgs.
"U.S. Appl. No. 14/560,576, Final Office Action dated Dec. 20, 2017", 11 pgs.
"U.S. Appl. No. 14/560,576, Non Final Office Action dated Apr. 7, 2017", 15 pgs.
"U.S. Appl. No. 14/560,576, Notice of Allowance dated Mar. 26, 2018", 9 pgs.
"U.S. Appl. No. 14/560,576, PTO Response to Rule 312 Communication dated May 1, 2018", 2 pgs.
"U.S. Appl. No. 14/560,576, Response filed Mar. 2, 2018 to Final Office Action dated Dec. 20, 17", 9 pgs.
"U.S. Appl. No. 14/560,576, Response filed Oct. 6, 2017 to Non Final Office Action dated Apr. 7, 2017", 9 pgs.
"U.S. Appl. No. 16/026,189, Examiner Interview Summary dated Nov. 13, 2018", 2 pgs.
"U.S. Appl. No. 16/026,189, Final Office Action dated May 1, 2019", 9 pgs.
"U.S. Appl. No. 16/026,189, Non Final Office Action dated Oct. 9, 2018", 9 pgs.
"U.S. Appl. No. 16/026,189, Notice of Allowance dated Nov. 15, 2019", 10 pgs.
"U.S. Appl. No. 16/026,189, Preliminary Amendment filed Jul. 3, 2018", 6 pgs.
"U.S. Appl. No. 16/026,189, Response filed Jan. 8, 2019 to Non Final Office Action dated Oct. 9, 2018", 5 pgs.
"U.S. Appl. No. 16/026,189, Response filed Sep. 27, 2019 to Final Office Action dated May 1, 2019", 6 pgs.
"International Application Serial No. PCT/US2012/034368, International Preliminary Report on Patentability dated Oct. 31, 2013", 5 pgs.
"International Application Serial No. PCT/US2012/034368, International Search Report dated Jul. 5, 2012", 2 pgs.
"International Application Serial No. PCT/US2012/034368, Written Opinion dated Jul. 5, 2012", 3 pgs.
"International Application Serial No. PCT/US2016/013785, International Search Report dated Apr. 22, 2016", 4 pgs.
"International Application Serial No. PCT/US2016/013785, Written Opinion dated Apr. 22, 2016", 5 pgs.

* cited by examiner

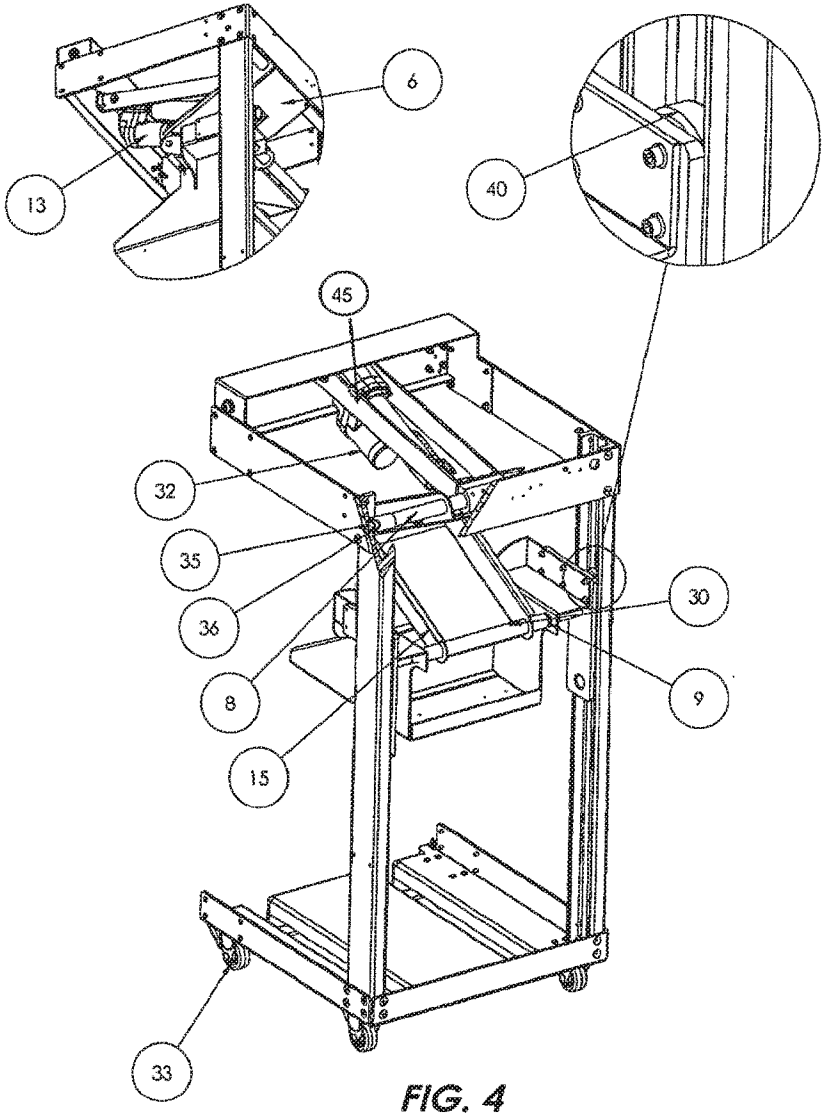
FIG. 4B
FIG. 4A
FIG. 4
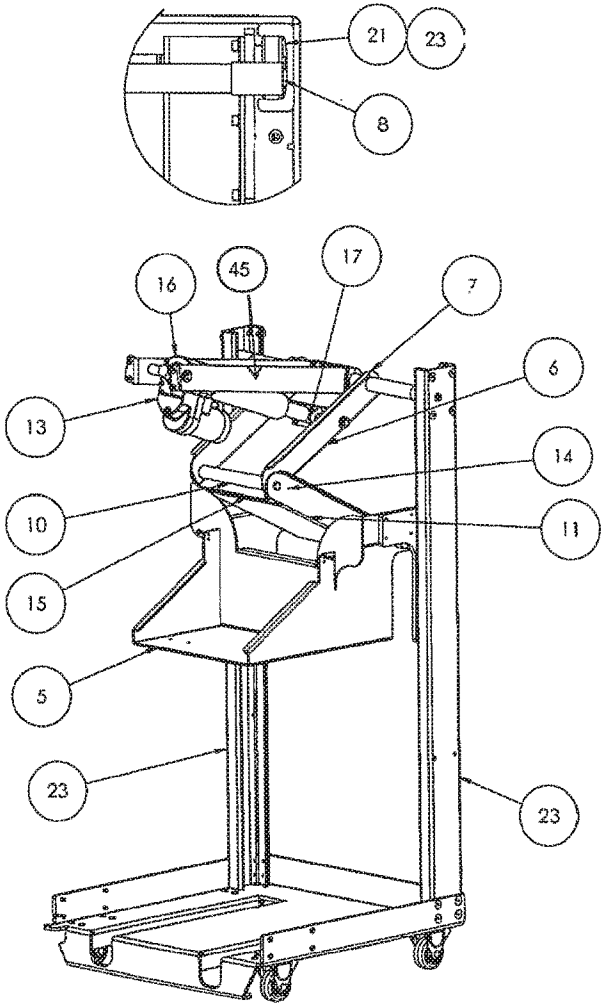
FIG. 3A
FIG. 3

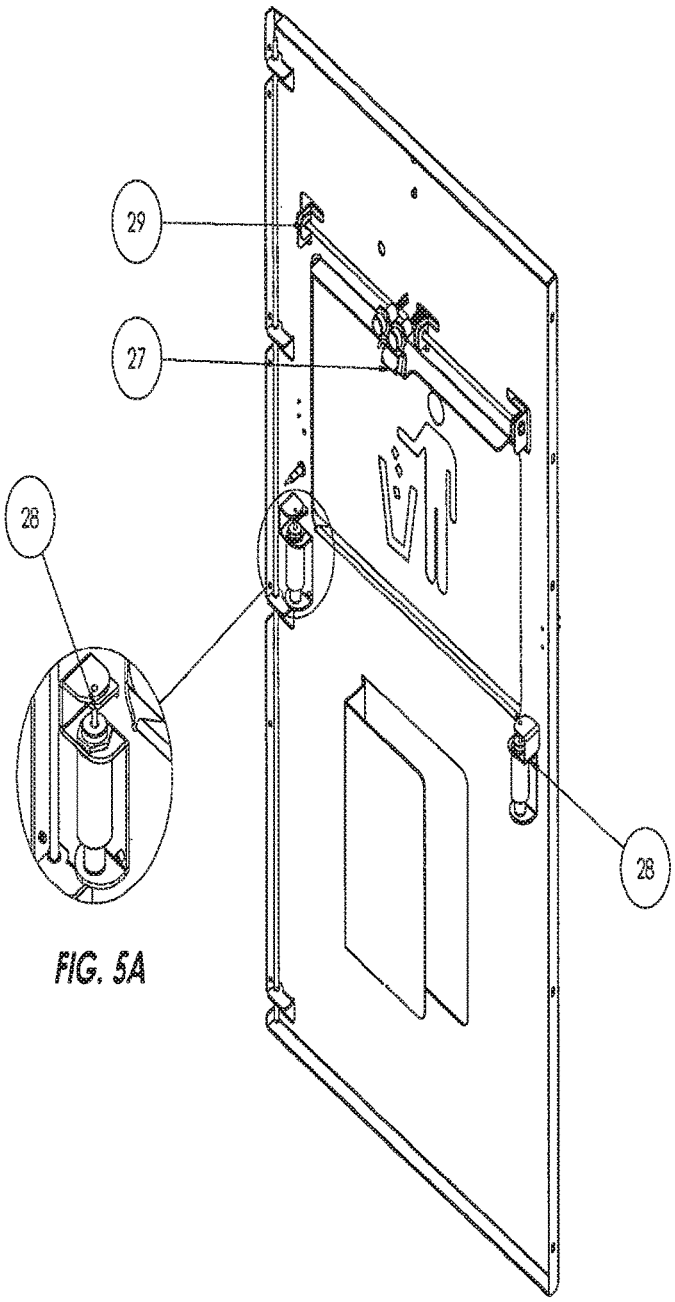
FIG. 5A
FIG. 5
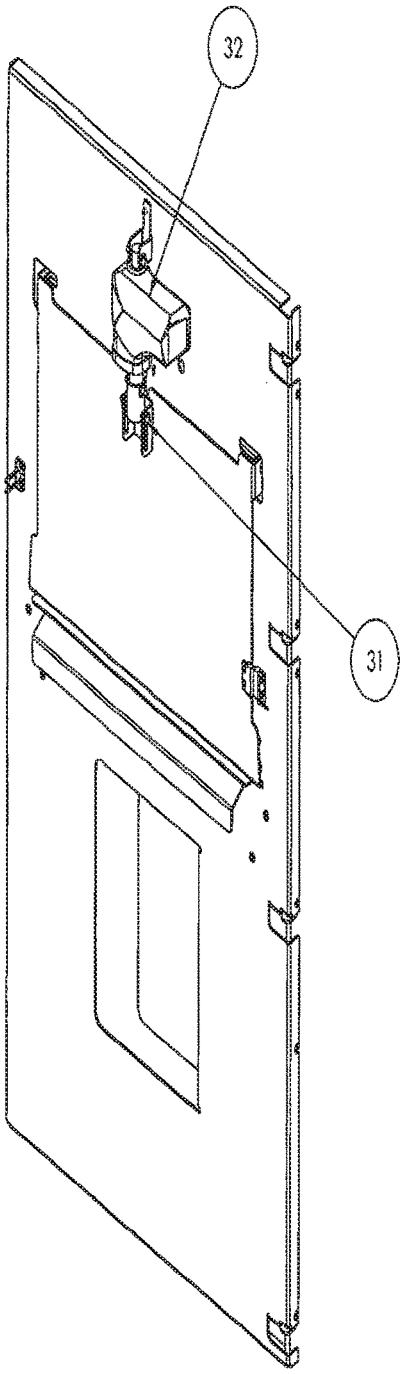
FIG. 6

TRASH COMPACTOR

CROSS REFERENCE TO RELATED APPLICATIONS

This application is a continuation of U.S. patent application Ser. No. 16/026,189, filed Jul. 3, 2018, which issued on Mar. 24, 2020 as U.S. Pat. No. 10,596,775, which application is a continuation in part of U.S. patent application Ser. No. 13/091,004, which is itself a continuation in part of U.S. patent application Ser. No. 12/144,235, which issued on May 31, 2011 as U.S. Pat. No. 7,950,325, all of which are hereby incorporated by reference into the present Application in their entireties.

BACKGROUND

Field of the Invention

This invention pertains to field of Trash Compactors.

Description of Related Art

Trash compactors generally operate in an environment where materials are to be crushed to reduce the overall volume of those materials. Often a platen is driven into a receptacle to accomplish this purpose. Maintaining alignment of the platen in a roughly parallel aspect relative to the bottom of the receptacle under uneven backpressure of the compressed material is a significant problem to be solved in this technology. Several approaches to solving this problem are known in the art.

One class of solutions to this problem is the use of Dual Scissor assemblies which provide four points of contact with the platen to maintain the required alignment. U.S. Pat. No. 4,548,132, to Moon, U.S. Pat. No. 4,100,850, to Wobink et al, U.S. Pat. No. 4,054,088, to Nee, U.S. Pat. No. 4,024,806, to Weeks et al, U.S. Pat. Nos. 4,024,806, and 4,000,689, to Weeks et al, U.S. Pat. No. 4,000,689 to Karls et al, U.S. Pat. No. 3,817,170 to Mayer, and U.S. Pat. Nos. 3,817,170, 3,722,404, and 3,714,890 to Moon all exemplify this solution.

BRIEF SUMMARY OF THE INVENTION

The Trash Compactor comprises: a frame defining a cavity, a trash receptacle, for containing trash, and disposed within the frame, a platen movable to compress trash collected in the trash receptacle, a upper set of linkages having a first end attached to the frame by a first simple hinge joint, the first simple hinge joint having an axis of rotation, and a second end attached to the platen by a second simple hinge joint, the upper set of linkages operating in a first plane normal to the axis of rotation of the first simple hinge joint, said upper set of linkages comprising two or more link elements, a lower set of linkages having a first end attached to the frame by a third simple hinge joint, the first simple hinge joint having an axis of rotation, and a second end attached to the platen by a fourth simple hinge joint, the lower set of linkages operating in a second plane normal to the axis of rotation of the third simple hinge joint, said lower set of linkages comprising two or more link elements, a drive mechanism configured to drive said platen up and down, said drive mechanism further configured as one of said link elements.

The Trash Compactor of may further comprise a second drive mechanism, said second drive mechanism configured to move the platen up and down, said second drive mechanism further configured as one of said link elements.

In a second embodiment, the Trash Compactor comprises: a frame defining a cavity, a trash receptacle for containing trash disposed within the frame, a platen movable to compress trash collected in the trash receptacle, one set of linkages having a first end attached to the frame by a first simple hinge joint, the first simple hinge joint having an axis of rotation, and a second end attached to the platen by a second simple hinge joint, the upper set of linkages operating in a first plane normal to the axis of rotation of the first simple hinge joint, said upper set of linkages comprising two or more link elements, a platen guide mechanism configured to restrict the motion of said platen in an up and down manner.

BRIEF DESCRIPTION OF THE SEVERAL VIEWS OF THE DRAWING

FIG. 3 is a front perspective view of Trash compactor drive mechanism.

FIG. 3A is a detailed top view of Trash compactor linear guide system.

FIG. 4 is a rear perspective view of Trash compactor drive mechanism.

FIG. 4A is a detailed perspective view of Trash compactor drive mechanism FIG. 4B is a detailed perspective view of the Trash Compactor's Platen Guide mechanism.

FIG. 5 is a front perspective view of Trash compactor service door.

FIG. 5A is a detailed perspective view of Trash door locking mechanism.

FIG. 6 is a rear perspective view of Trash compactor service door.

DETAILED DESCRIPTION OF THE INVENTION

Figure 1:
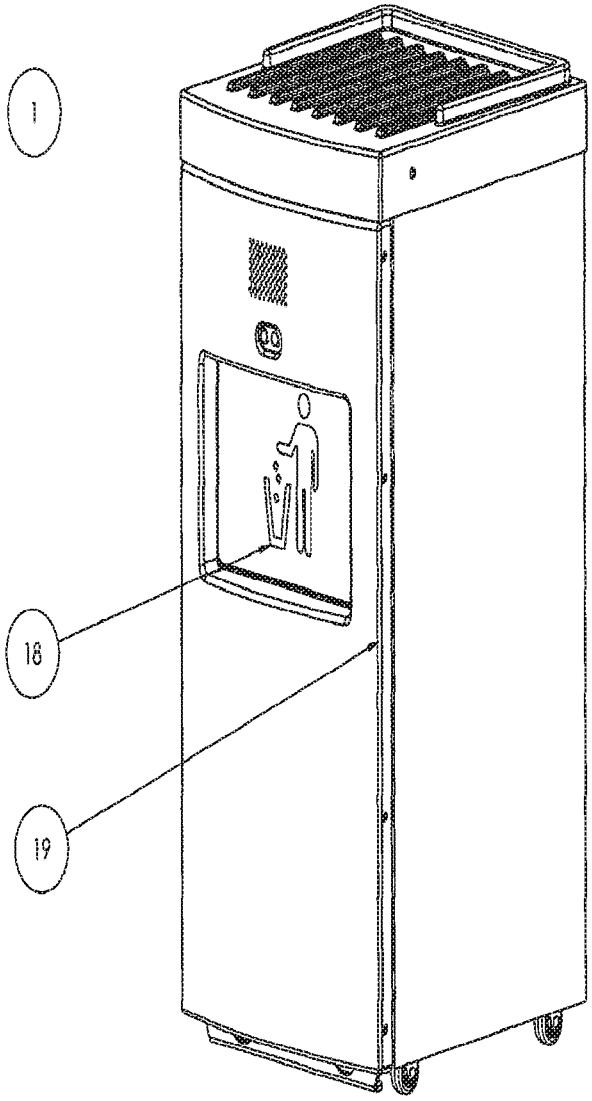
FIG. 1 is a perspective view of Trash compactor complete.
Figure 2:
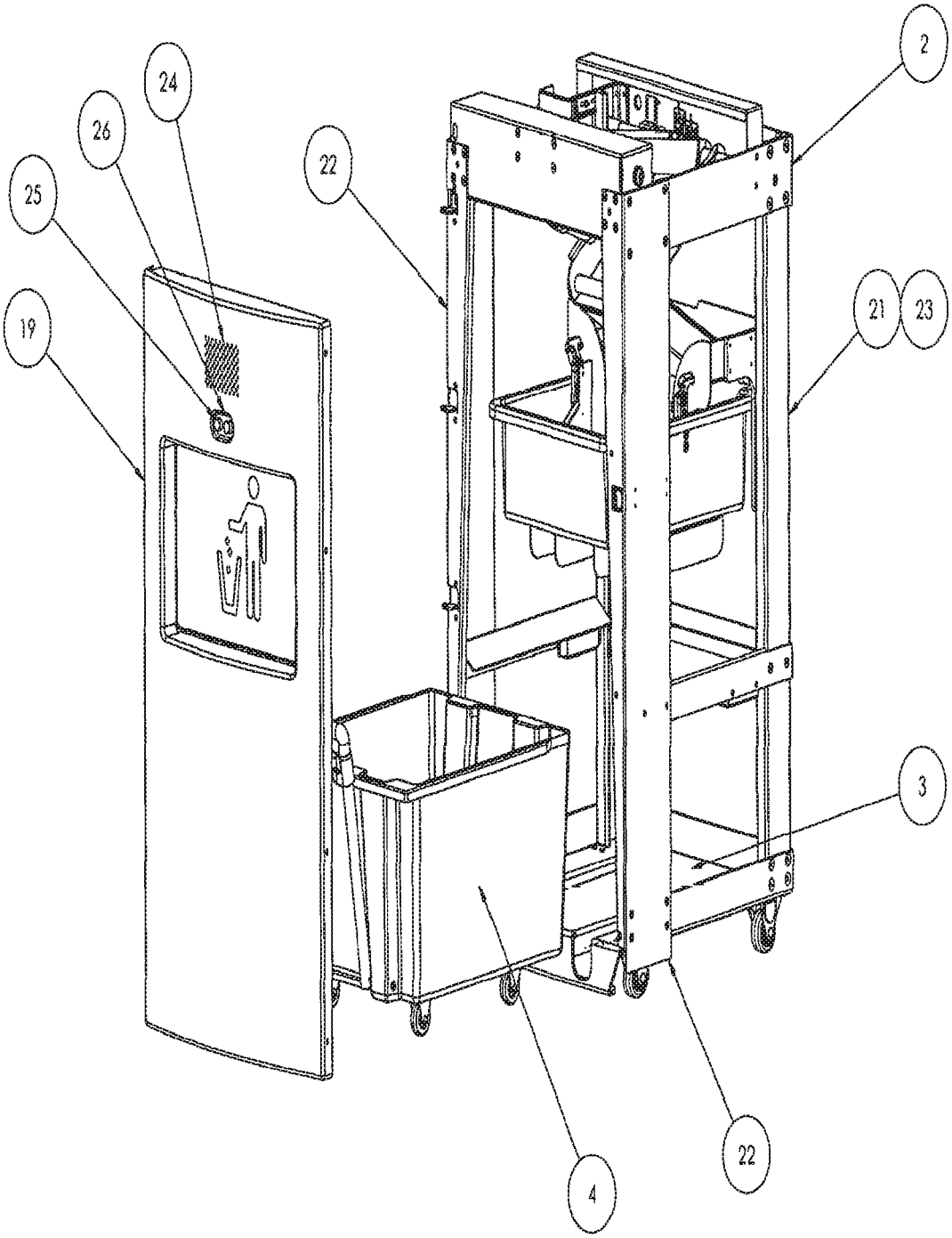
FIG. 2 is an exploded view of Trash compactor no skins.
Figure 7:
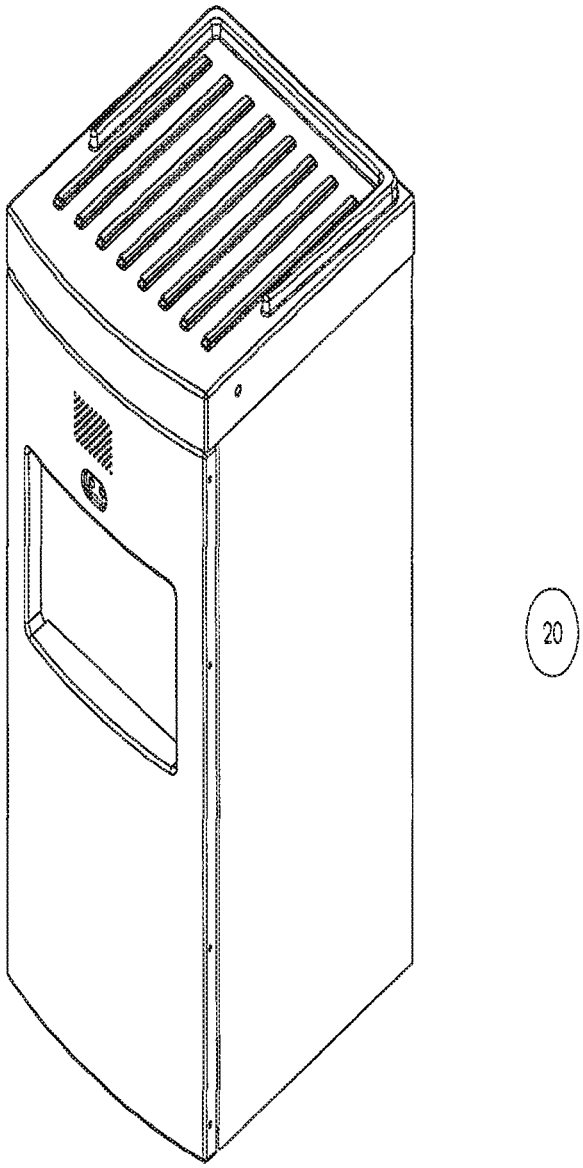
FIG. 7 is a perspective view of Trash compactor skins.

The following detailed description should be read with reference to the drawings in which similar elements in different drawings are numbered the same. The detailed description and the drawings, which are not necessarily to scale, depict illustrative embodiments and are not intended to limit the scope of the invention. The illustrative embodiments depicted are intended only as exemplary. Selected features of any illustrative embodiment may be incorporated into an additional embodiment unless clearly stated to the contrary.

The Trash Compactor 1 comprises: a frame 2 defining a cavity 3, a trash receptacle 4, for containing trash, and disposed within the frame 2, a platen 5 movable to compress trash collected in the trash receptacle 4, an upper set of linkages 6 having a first end 7 attached to the frame 2 by a first simple hinge joint 8, the first simple hinge joint 8 having an axis of rotation, and said upper set of linkages having a second end attached to the lower set of linkages 11 by a second simple hinge joint 10, the upper set of linkages 6 operating in a first plane normal to the axis of rotation of the first simple hinge joint 8, said upper set of linkages 6 comprising two or more link elements, a lower set of linkages 11 having a second end 14 attached to the upper linkage by the second simple hinge joint 10, the first simple hinge joint 8 having an axis of rotation, and said lower set of linkages 11 attached to the platen 5 by a fourth simple hinge joint 30, the lower set of linkages 11 operating in a second plane normal to the axis of rotation of the second simple hinge joint 10, said lower set of linkages 11 comprising two or more link elements, a drive mechanism 13 configured to drive said platen 5 up and down, said drive mechanism 13 further configured as one of said link elements. The Trash Compactor 1 of may further comprise a second drive mechanism 13, said second drive mechanism 13 configured to move the platen 5 up and down, said second drive mechanism 13 further configured as one of said link elements.

In a second embodiment, the Trash Compactor 1 comprises: a frame 2 defining a cavity 3, a trash receptacle 4 for containing trash disposed within the frame 2, a platen 5 movable to compress trash collected in the trash receptacle 4, one set of linkages having a first end 7 attached to the frame 2 by a first simple hinge joint 8, the first simple hinge joint 8 having an axis of rotation, and said one set of linkages having a second end attached to the platen 5 by a second simple hinge joint 10, the upper set of linkages 6 operating in a first plane normal to the axis of rotation of the first simple hinge joint 8, said upper set of linkages 6 comprising two or more link elements, a platen guide 21 mechanism, said platen guide mechanism 21, configured to restrict the motion of said platen 5 in an up and down manner.

The second embodiment may further comprise a first drive mechanism 13 attached to said frame 2 and to said linkage to move the platen 5 up and down.

The second embodiment may further comprise a first drive mechanism 13 configured as one of said link elements and to move said platen 5 up and down.

A Trash Compactor 1 generally includes a case 20, which surrounds the unit on all sides and the top. The front side of the case 20 includes at least one service door 19. It will be appreciated that the overall shape of a Trash Compactor 1 may include other than rectangular shapes, for example, hexagonal, octagonal, circular, and Oval are just a few of the infinite number of choices. Usually Trash Compactors 1 include a frame 2 which provides the structure to which all the other components are attached. The frame 2 may be integral to the design of the outer case 20 or may be independent of the outer case 20.

The Trash Compactor 1 is used in at least two different ways. In one case a person places trash in the compactor and in another a person removes compacted trash from the Trash Compactor 1. A person placing trash in the Trash Compactor 1 the inlet door 18 is opened either manually or by a proximity sensor 27 or other sensor is triggering an opening mechanism. In all cases at predetermined intervals or after a predetermined number of inlet door 18 cycles the compacting mechanism compacts the trash in the trash receptacle 4. The Trash Compactor 1 may provide a signal to indicate that the trash receptacle 4 is full and the liner should be replaced. This may be done by opening up the service door 19 and wheeling out the trash receptacle 4. Interlocks are provided to prevent compaction cycles from occurring while either of the service door 19 or the inlet door 18 is open, thus preventing possible injury to such users.

Another use of the Trash Compactor 1 is removal of the compacted trash. This occurs when the service door 19 is opened and the trash receptacle 4 is removed and emptied. This may include automatic dispensing of the trash receptacle 4.

The case 20 may be fixed to the frame 2 and may be made of panels of metal, plastic, acrylic, wood, or a combination of such materials or other suitable material or combination of materials. The case 20 may include, for example, a tray collector molded into its top panel. The case 20 configuration may vary depending on the contemplated installation of the Trash Compactor 1. For example, for a cabinet mounted configuration, where only the front panel of the Trash Compactor 1 is exposed, the case 20 may be reduced to only the front panel and inlet door 18. The inlet door 18 may include a lockable door latch 28, which can be operated to open the inlet door 18. In this embodiment, the service door 19 may be opened regularly to provide access to the trash receptacle 4 and provide access to service the internal mechanisms of the Trash Compactor 1. The Trash Compactor 1 may also include one or more speaker apertures 24, signal light aperture **26*s*, and proximity sensors 27**.

Speaker aperture 24 may be a regular array of holes or other opening or set of openings through which a speaker may be heard. The speaker aperture 24 may be placed in the service door 19 or any suitable location on the case 20 of the Trash Compactor 1. Likewise, signal light aperture 26 may be an opening or set of openings through which a signal light 25 may be seen. The Signal light aperture 26 may include a transparent or translucent cover or may be a naked hole in the service door 19 or any suitable place on the case 20. The light may also be mounted to the frame 2 so that it does not move with the service door 19 or inlet door 18. Other suitable auditory and visual output mechanisms may be included. Such mechanisms can be used to provide cues and information to users, who are throwing trash into the Trash Compactor 1, and service people, who may empty the trash receptacle 4 and perform other maintenance tasks.

In the illustrated embodiment a proximity sensor 27 is mounted in the service door 19 directly above the inlet door 18 and senses movement near to the sensor. Other contemplated locations for the proximity sensor 27 or for a second proximity sensor 27 include locations on the inlet door 18. The proximity sensor 27 provides signals to the inlet door 18 opening mechanism and can be adjusted or configured to provide a desired level of sensitivity and range of detection.

In the embodiment illustrated the back of the service door 19 is provided with a latch 28, a proximity sensor 27, a speaker aperture 24, and a signal light aperture 26. It can also be seen that the inlet door 18 is mounted to the service door 19 with a hinge 29, about which the inlet door 18 pivots. The hinge 29 may include a flex sensor by which the location of the inlet door 18 may be monitored. The inlet door 18 hinge 29 may also be spring-loaded to return to the closed position. One or more additional inlet door 18 sensors may also be included to provide redundant information to the control unit on the location of the inlet door 18. Any suitable sensor, such as a magnetic sensor or a solenoid sensor may be used. A solenoid or other suitable locking mechanism may also be included to lock the door closed during compacting operations.

In the illustrated embodiment the inlet door 18 includes an opening mechanism. The opening mechanism has two portions, one of which may be mounted to the inlet door 18 and one of which may be mounted to the frame 2 or service door 19.

The first portion of the opening mechanism, which is mounted to the inlet door 18 and the service door 19, includes a T-shaped linkage 31, the upper end of which rests on a pin and the lower end of which is pivotably connected to a strut. The strut, in turn, is pivotably connected to the service door 19. A linkage is preferably confined by brackets to the service door 19 so that it can only move vertically. As the linkage moves up or down, the inlet door 18 opens or closes.

The second portion, which is mounted to the case 20 or frame 2, includes a motor 32, a rotatable arm and a pin. The pin is offset from the rotational output of the motor 32 so that the motor 32 can rotate the pin along an arc. Because the T-shaped linkage 31 rests on the pin, it can be raised either by the pin or independently of it. Further, the service door 19 can be opened and closed easily, as the link between the two portions of the mechanism is easily separated and rejoined. It will be appreciated that any mechanism by which the pin can be lifted up and down may be used in the second portion of the opening mechanism. The motor 32 may be selected to retain the position of its output mechanism when power is cut. Thus, for example, if a Trash Compactor 1 loses power when the inlet door 18 is open, the inlet door 18 will be retained in its position and not close, thus preventing injury to potential users.

Because the first portion of the mechanism can, in some instances, be moved independently of the second portion, there are thus two ways of opening the inlet door 18. In one method, a signal from the proximity sensor 27 is received by a controller, which then tells the motor 32 to rotate. As the pin is rotated by the motor 32, it slides along the T-shaped linkage 31 while raising its vertical position. As the pin is lifted, so too is the T-shaped linkage 31, which, because it is mechanically linked to the inlet door 18, opens the inlet door 18.

In a second method, the inlet door 18 can be pushed in by a person throwing trash away. The T-shaped linkage 31 is thereby raised independently of the pin. Because the sensors can detect the inlet door 18 opening, the pin can be raised to the T-linkage to keep the inlet door 18 in the open position and to provide for a controlled inlet door 18 closing. Alternatively, pushing on the inlet door 18 triggers one of the inlet door 18 sensors, which sends a signal to the controller. Examples of suitable sensors include solenoids, magnetic sensors, flex sensors, proximity sensors 27, and other sensors capable of detecting the users intent to open the inlet door 18. The controller then tells the motor 32 to rotate. In this manner, a person who pushes on the inlet door 18 may be assisted by the opening mechanism in opening the inlet door 18.

The door mechanism may also include stop limiters attached to the inlet door 18, the case 20 or the frame 2 to limit the extent that the inlet door 18 may be opened. Of course, other suitable opening mechanisms for the inlet door 18 may be used in various embodiments.

The frame 2 includes two vertical rear posts 23 and two vertical front posts 22 that are connected to a top frame 2 and a U-shaped bottom frame 2. The two rear posts 23 may be L-shaped and most of the two front posts 22, except for a lower front portion widened to receive the trash receptacle 4, are L-shaped as well. A front cross-piece, mounted above the location of the trash receptacle 4, may also be included to provide additional rigidity and strength. The frame 2 also includes a top cross-piece, which is used in attaching and supporting the compacting mechanism. The frame 2 may be made from steel or other suitably strong material and may be assembled by bolts, welding, manufacturing components together, or some other suitable technique. As shown in FIGS. 3-4, a cross member 45 may be provided that extends across a top portion of the frame substantially orthogonally to the axis of rotation of the first simple hinge joint. The cross member 45 may include a first end and the cross member 45 may have a second end coupled to the frame along the axis of rotation.

The frame 2 is preferably mounted on wheels 33. Alternatively, the frame 2 may also be set directly on feet or on the ground or other suitable surface. In this embodiment, the overall shape is that of a rectangular box. In other embodiments, the Trash Compactor 1 may have a different overall shape and correspondingly different frame 2 components. For example, the Trash Compactor 1, and thus the frame 2, may have a cylindrical shape. The frame 2 may also be made using other techniques. For example, each side of the frame 2 may be stamped from a single piece of material and the sides may then be joined using a suitable technique.

The rear posts 23 may also serve as guides 21 for the motion of the Platen 5. When serving this function the rear posts 23 are preferably U-shaped to accommodate a pair of guides 21. These guides 21 are rigidly attached to the platen 5 and the guides 21 are slideably contained within the U-shaped rear posts 23 to maintain the platen 5 in a horizontal orientation. The guides 21 may be implemented using wheels or slide blocks.

The wheels 33 of the Trash Compactor 1 or the bottom of the frame 2 provide room for a trash receptacle 4 support. The trash receptacle 4 support is a bottom panel piece that includes that guide and support the trash receptacle 4. The trash receptacle 4 support may include detents or holes that correspond to the wheels 33 or other aligning features of the trash receptacle 4. These detents may provide tactile feedback to indicate when the trash receptacle 4 is properly placed, may keep the trash receptacle 4 from moving out of position and may allow the trash receptacle 4 support bear the force during a compaction cycle.

The compaction cycle is accomplished by forcing the platen 5 downward to compress the contents of the trash receptacle 4. This is accomplished by a linkage mechanism. This linkage has two ends, one end is attached to the frame 2 and the other to the platen 5. In the retracted position the platen 5 is raised to a maximum elevation within the space defined by the frame 2. To accomplish compression of the trash contained within the trash receptacle 4 the linkage mechanism is extended downward which forces the platen 5 downward. The extension of the linkage mechanism is accomplished by lengthening one or more of the linkage members by a drive mechanism 13 placed as one of the members of the linkage mechanism. A scissors type linkage mechanism is a common type linkage mechanism readily adapted to this use. The drive mechanism 13 can be a hydraulic cylinder, an electric screw driven mechanism, or any suitable mechanism which itself extends in length and exerts sufficient force at the ends of the drive mechanism 13 to force the linkage mechanism to extend. In situations where resistance to motion may be encountered by the platen 5 and that resistance is not evenly distributed across the platen 5 a guide 21 mechanism can be employed to maintain the platen 5 in a fixed orientation relative to the case 20.

The platen 5 is a component with a generally flat bottom surface for compressing the trash into the trash receptacle 4 and may include side walls and upper lip to align the platen 5 within the trash receptacle 4 and to prevent trash from accumulating on the platen 5. Preferably, the side walls are sized so that the upper lip is always above the trash receptacle 4. Ordinarily, when trash is being compressed in the trash receptacle 4, the side walls of the platen 5 are at least partially disposed within the trash receptacle 4. This confines trash to the trash receptacle 4 and prevents contamination of the compacting mechanism. Further, the upper lip, which extends outwardly from the side walls directs any potential spray of liquid trash away from the compacting mechanism.

It can be appreciated that the cross-sectional shape of the platen 5 and the cross-sectional shape of the trash receptacle 4 should preferably correspond so that the platen 5 is compressing the entire surface of the trash. A square or rectangular shape is the most efficient shape for the platen 5 and the trash receptacle 4, though of course other shapes, such as circular or octagonal are within certain embodiments. The platen 5 may also include a beveled front edge, which accommodates the opening of the inlet door 18. A chamfer on the rear edge may also be included. In embodiments that include a rear inlet door 18, this rear chamfer may accommodate the opening of the rear inlet door 18. These chamfers also aid in removing trash and add rigidity. In one contemplated embodiment, the platen 5 may include chamfers around the circumference of the flat bottom surface. The flat bottom surface may also include ribs or ridges to create higher and lower pressure areas to better compress the trash.

It will be understood that more than one linkage mechanism as described above may be used. However, only one linkage will be discussed, although it should be understood that the discussion is applicable to each linkage. The linkage has three components, the upper linkage 34, the lower linkage 11 and the drive mechanism 13. The upper linkage 34 has a first end 7 rotatably connected to the frame 2 and a lower end connected to lower linkage 11. The lower linkage 11 has an upper end 14 connected to the upper linkage 34 and a second end 9 connected to platen 5. The drive mechanism 13 has a fixed end 16 connected to the frame 2 and a movable end 17 connected to upper linkage 34 between the first and lower ends of the upper linkage 34. Changing the length of the linkages and the connection position of the drive mechanism 13 changes the force applied to the platen 5 and the distance the platen 5 may travel. In one embodiment, the linkages may not be completely retracted when the platen 5 is in its highest position so that there is a slight angle between the upper linkage band lower linkage 11. Each of the connections to the upper, lower and drive mechanism 13 allows one degree of rotational freedom. Such connections shall be referred to herein as simple hinge joints. Simple hinge joints can be formed between the linkages by using pins whose ends are captured using C-rings, by press-fitting a pin into one of the linkages and capturing the other end of the pin with a C-ring, or by some other suitable method. Other components such as roller or ball bearings may be included as well.

The upper linkage 34 may be fabricated from a single U-shaped component. The U-shaped component has two sides and a bottom. The sides should be of sufficient dimension to permit rotatable connection of the upper linkage 34 to: 1) the frame 2, 2) the lower linkage 11, and 3) the drive mechanism 13. The bottom of the U-shaped component should be of sufficient dimension to provide lateral stability of the entire linkage mechanism when subjected to the forces encountered during the compaction cycle.

The linkages, in cooperation with the platen 5 guide 21 mechanism cooperatively stabilize and fix the position of platen 5. The compacting mechanism can thereby go from a fully raised position to a fully extending position.

A control system controls the operation of the Trash Compactor 1. The control system can take inputs such as the position of the inlet door 18, how many times the inlet door 18 has been opened, the time since the last operation of the compaction mechanism, the current draw of the motor 32 and so forth to operate the Trash Compactor 1. One possible mode of operation involves operating the compacting mechanism after the inlet door 18 has been opened a predetermined number of times. For example, after the inlet door 18 has been opened ten times, the control system closes and locks the inlet door 18 shut and operates the compacting mechanism.

The stroke length of the platen 5 may be determined by how many times the compacting mechanism has been operated since the liner to the trash receptacle 4 has been last changed, it might be operated until a predetermined amount of force has been applied to the trash by the platen 5, or it might have a fixed length unless a predetermined force level has been exceeded. Other operating modes may be programmed as desired.

It is to be appreciated that the compacting mechanisms described herein may be suitable for other uses than in a Trash Compactor 1. Any application where force is applied over a surface may be suitable. For example, the compacting mechanism may be suitable for use in a food press, printing press, or even an automobile crusher.

Figure 8:
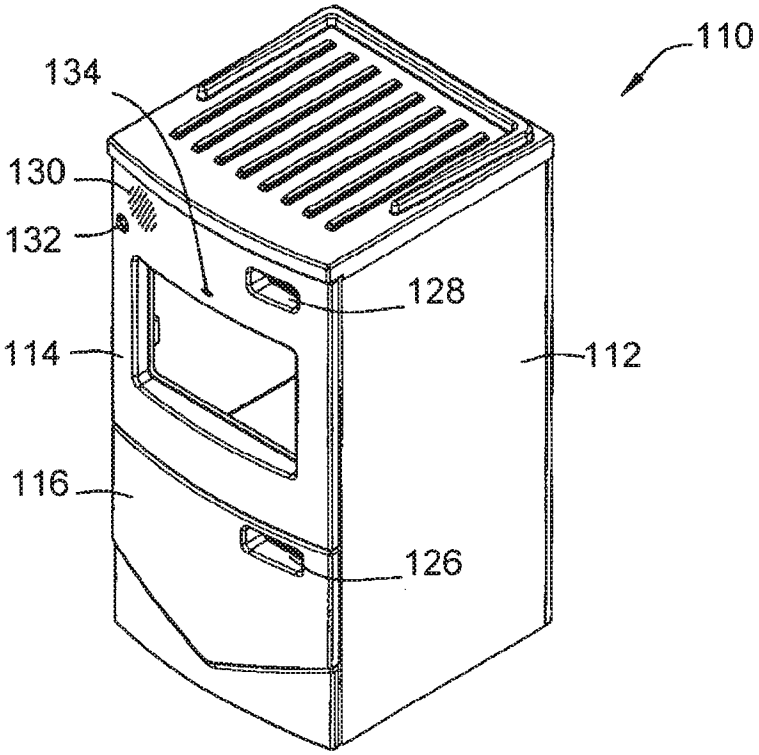
FIG. 8 is a perspective view of one embodiment of a trash compactor.

By way of general overview, a trash compactor 110, shown in perspective view in FIG. 8, includes a housing 112, which surrounds the unit on the four sides and the top. The front side of the housing includes an upper door 114 and a lower door 116. The upper door 114, which will be described in more detail below, includes an inlet door 118, through which trash is disposed of into the unit. Some of the major internal components not shown in this first figure include the compacting mechanism 120, trash receptacle 122 and frame 124. The frame, of course, provides the structure to which all the other components are attached.

The operation of the trash compactor may start with providing a liner for the trash receptacle. When a person approaches the trash compactor, a proximity sensor or other sensor is triggered to open the inlet door, which allows the person to introduce garbage through the inlet door. Alternatively and in at least one embodiment, the inlet door may also open when a person pushes on it. At predetermined intervals the compacting mechanism compacts the trash in the trash receptacle. The trash compactor may provide a signal to indicate that the trash receptacle is full and the liner should be replaced. This may be done by opening up the lower door and wheeling out the trash receptacle.

The housing 112 may be fixed to the frame and may be made of panels of metal, plastic such as acrylic, wood, a combination of such materials or other suitable material or combination of materials. The housing may include, for example, a tray collector molded into its top panel. The housing configuration may vary depending on the contemplated installation of the trash compactor. For example, for a cabinet mounted configured, where only the front panel of the trash compactor is exposed, the housing may be reduced to only the upper and lower doors of the front panel, may eliminate the upper panel, or some other preferred configuration. Lower door 116 may include a lower door latch 126, which may be lockable, and which may be operated to open the lower door. Likewise, the upper door 114 may include a lockable upper door latch 128, which can be operated to open the upper door panel. In this embodiment, the lower door may be opened regularly to provide access to the trash receptacle while the upper door, while operable, needs to be opened only to provide access to service the internal mechanisms of the trash compactor. As can be seen from FIG. 8, upper door 114 may also include speaker aperture 130, signal light aperture 132 and proximity sensor 134.

Speaker aperture 130 may be a regular array of holes or other opening or set of openings through which a speaker may be heard. In this embodiment, a speaker (not illustrated) is mounted to the frame 124 and does not move with upper door 114 when it is opened. Likewise, signal light aperture 132 may be an opening or set of openings through which a signal light may be seen. Signal light aperture 132 may include a transparent or translucent cover or may be a naked hole in the upper door. The light may be mounted to the frame so that it does not move with upper door 114 when it is opened. Of course, both the speaker and the signal light may be mounted to the upper door if desired or may be located in another part of the housing. Other suitable auditory and visual output mechanisms may be included. Such mechanisms can be used to provide cues and information to users, who are throwing trash into the trash compactor, and service people, who may empty the receptacle and perform other maintenance tasks. In this embodiment, proximity sensor 134 is mounted in the upper door 114 directly above the inlet door 118 and senses movement near to the sensor. Other contemplated locations for the proximity sensor or for a second proximity sensor include locations on the inlet door. The proximity sensor provides signals to the inlet door opening mechanism and can be adjusted or configured to provide a desired level of sensitivity and range of detection.

Figure 9:
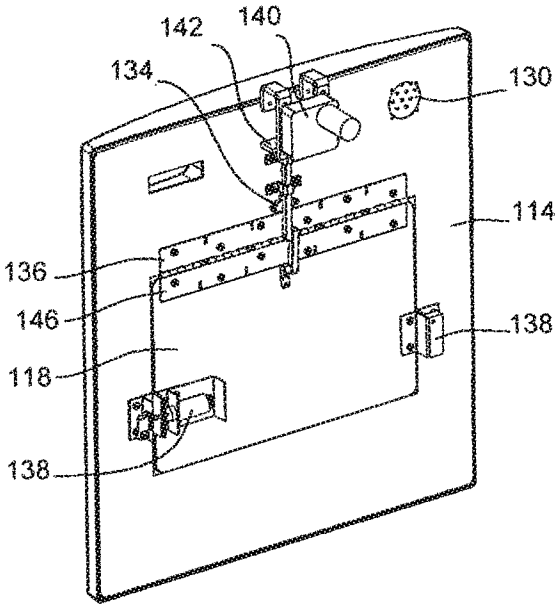
FIG. 9 is a rear perspective view of an upper door of the embodiment of FIG. 8.

Turning now to FIG. 9, the rear of upper door 114 is shown. The back of upper door latch 128, proximity sensor 134, speaker aperture 130 and signal light aperture 132 may be seen. It can also be seen that inlet door 118 is mounted to the upper door 114 with a hinge 136, about which the inlet door pivots. Hinge 136 may include a flex sensor by which the location of the inlet door may be monitored. The inlet door hinge may also be spring-loaded to return to the closed position. One or more additional inlet door sensors 138 may also be included to provide redundant information to the control unit on the location of the inlet door. Any suitable sensor, such as a magnet sensor or a solenoid sensor may be used. A solenoid or other suitable locking mechanism may also be included to lock the door closed during compacting operations.

Figure 10:
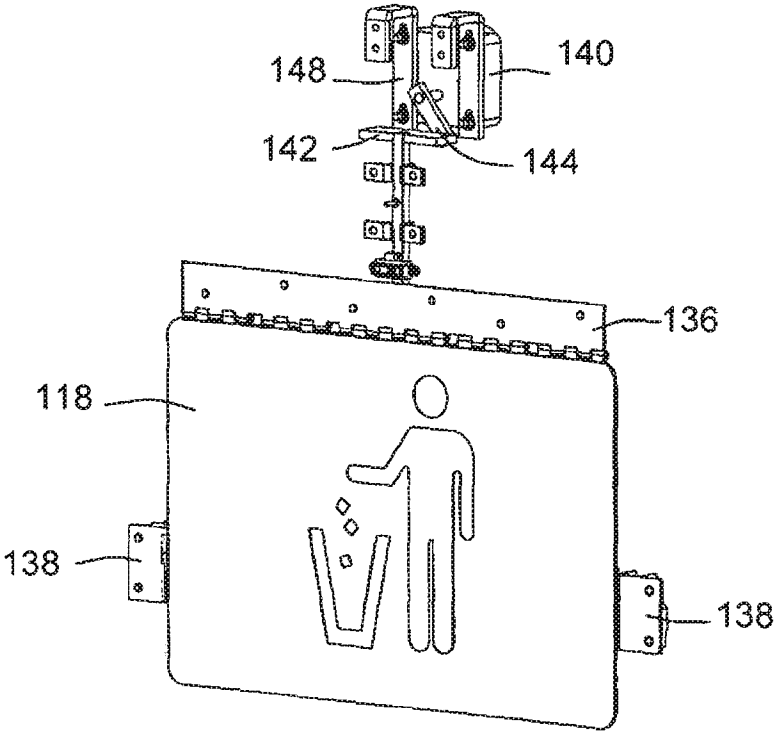
FIG. 10 is a front perspective view of certain elements of the upper door of FIG. 9.

The inlet door includes an opening mechanism 140. The opening mechanism has two portions, one of which may be mounted to the upper door and the inlet door and one of which may be mounted to the frame. The two portions are preferably designed to separate when the upper door is opened. The opening mechanism can be seen clearly with reference to FIGS. 9 and 10. FIG. 9 shows the rear of upper door 114. FIG. 10 is a front view of the opening mechanism that includes the inlet door hinge and the top portion of the inlet door, but in which has the upper door removed.

The first portion of the opening mechanism, which is mounted to the upper door and the inlet door, includes a T-shaped linkage 142, the upper end of which rests on a pin 144 and the lower end of which is pivotably connected to a strut 146. Strut 146, in turn, is pivotably connected to the inlet door. Linkage 142 is preferably confined by brackets to the upper door so that it can only move vertically. As the linkage 142 moves up or down, the inner door opens or closes.

The second portion, which is mounted to the frame, includes a motor 148, a rotatable arm and a pin 144. The pin is offset from the rotational output of the motor so that the motor can rotate the pin along an arc. Because the T-shaped linkage rests on pin 144, it can be raised either by the pin or independently of it. Further, the upper door can be opening and closed easily, as the link between the two portions of the mechanism is easily separated and rejoined. Of course, any mechanism by which pin 144 can be lifted up and down may be used in the second portion of the opening mechanism. The motor may be selected to retain the position of its output mechanism when power is cut. Thus, for example, if a trash compactor loses power when the inlet door is open, the inlet door will be retained in its position and not close on a user's arm.

Because the first portion of the mechanism can, in some instances, be moved independently of the second portion, there are thus two ways of opening the inlet door 118. In one method, a signal from the proximity sensor is received by a controller, which then tells the motor to rotate. As the pin is rotated by the motor, it slides along the T-shaped linkage while raising its vertical position. As the pin is lifted, so too is the T-shaped linkage, which, because it is mechanically linked to the inlet door, opens the inlet door.

In a second method, the inlet door can be pushed in by a person throwing trash away. The T-shaped linkage is thereby raised independently of the pin. Because the sensors can detect the inlet door opening, the pin can be raised to the T-linkage to keep the inlet door in the open position and to provide for a controlled door closing. Alternatively, pushing on the inlet door triggers one of the inlet door sensors, which sends a signal to the controller. Examples of suitable sensors include solenoids, magnetic sensors, flex sensors and the like. The controller then tells the motor to rotate. In this manner, a person who pushes on the inlet door may be assisted by the opening mechanism in opening the inlet door.

The door mechanism may also include stop limiters (not pictured) attached to the upper door, the housing or the frame to limit the extent that the inlet door may be opened. Of course, other suitable opening mechanisms for the inlet door may be used with various embodiments.

Figure 11:
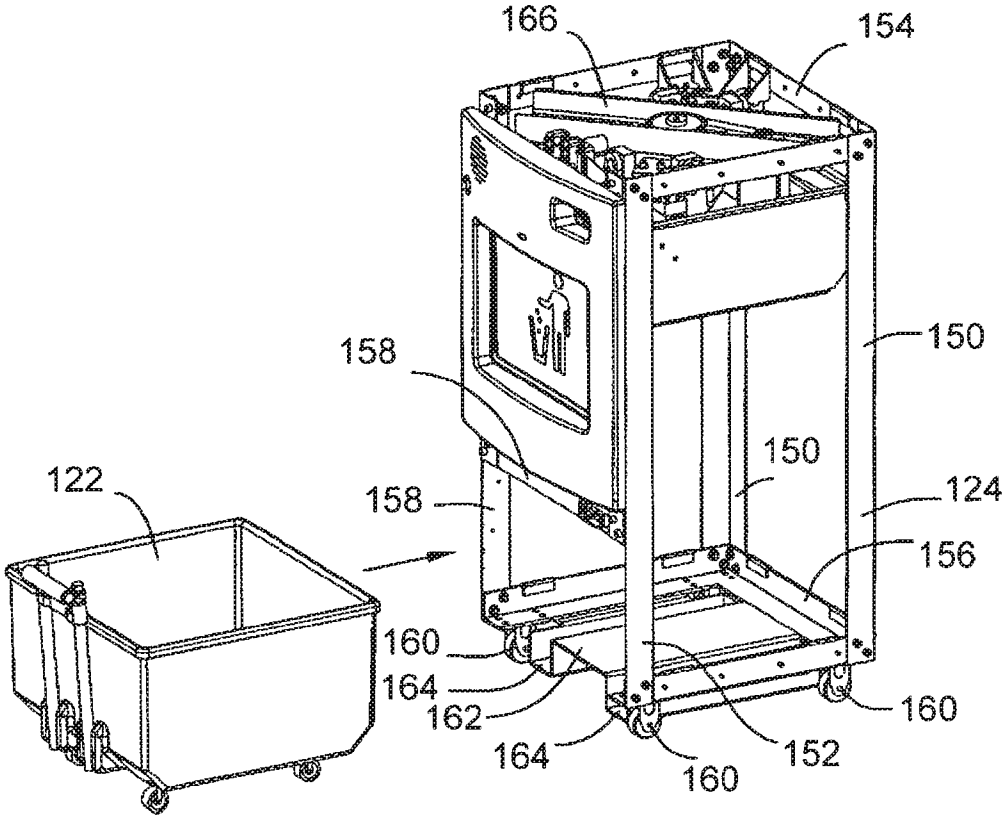
FIG. 11 is a perspective view of the embodiment of FIG. 8 with certain components removed.

Turning now to FIG. 11, frame 124 may be seen more fully. Frame 124 includes two vertical rear posts 150 and two vertical front posts 152 that are connected to a four-sided top frame 154 and a U-shaped bottom frame 156. The two rear posts 150 are L-shaped and most of the two front posts 152, except for a lower front portion widened to receive the trash receptacle, are L-shaped as well. A front cross-piece 158, mounted above the location of the trash receptacle, may also be included to provide additional rigidity and strength. The frame also includes a top cross-piece 166, which is used in attaching and supporting the compacting mechanism. The frame may be made from steel or other suitably strong material and may be assembled by bolts, welding, manufacturing components together, or some other suitable technique. The frame 124 is preferably mounted on wheels 160, though of course the frame may also be set directly on feet or on the ground. The frame defines the overall shape of the trash compactor. In this embodiment, the overall shape is that of a rectangular box. In other embodiments, the trash compactor may have a different overall shape and correspondingly different frame components. For example, the trash compactor, and thus the frame, may have a cylindrical shape. The frame may also be made using other techniques. For example, each side of the frame may be stamped from a single piece of material and the sides may then be joined using a suitable technique.

The wheels of the trash compactor or the bottom of the frame provide room for a trash receptacle support 162. The trash receptacle support is a bottom panel piece that includes channels 164 that guide and support the wheels of the trash receptacle. Preferably, the bottoms of channels 164 clear the floor by only a modest distance so that the trash receptacle can be easily wheeled into and off from support 162. The channels may include detents or holes that correspond to the wheels of the trash receptacle. These detents may provide tactile feedback to indicate when the trash receptacle is properly placed, may keep the trash receptacle from rolling out of position and may allow the trash receptacle support, rather than the wheels of the trash receptacle, to bear the brunt of the force during a compaction cycle.

Figure 15:
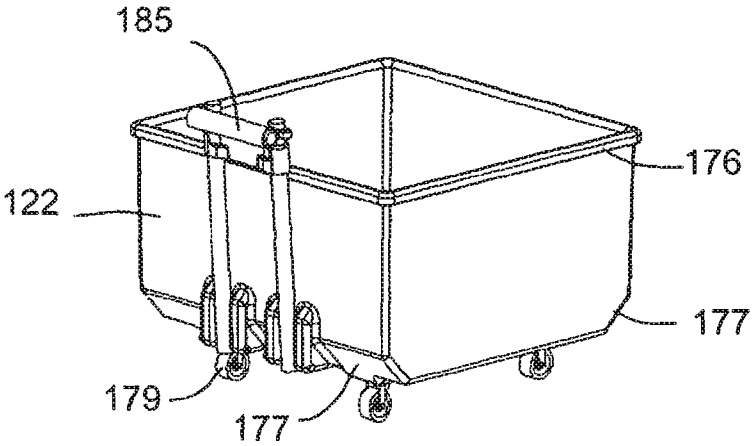
FIG. 15 is a perspective view of a trash receptacle for use with a trash compactor embodiment.

The trash receptacle 122, shown in FIG. 15, is preferably rectangular with vertical side walls. In one embodiment, the trash receptacle includes one or more beveled or curved edges 177 along its bottom surface. Such a configuration eliminates corners with sharp angles, may aid in guiding the trash receptacle into position and may make it easier to remove a brick of compacted trash from the trash receptacle. The trash receptacle may include wheels 179 to ease the movement of the trash receptacle into and out of position. A lip 176 on the upper rim of the trash receptacle may add rigidity. In one embodiment the trash receptacle is about 12 inches deep, although other dimensions are of course possible. Trash receptacle 122 may also include a handle 185 that may telescope up and down to provide easy maneuverability.

Figure 12:
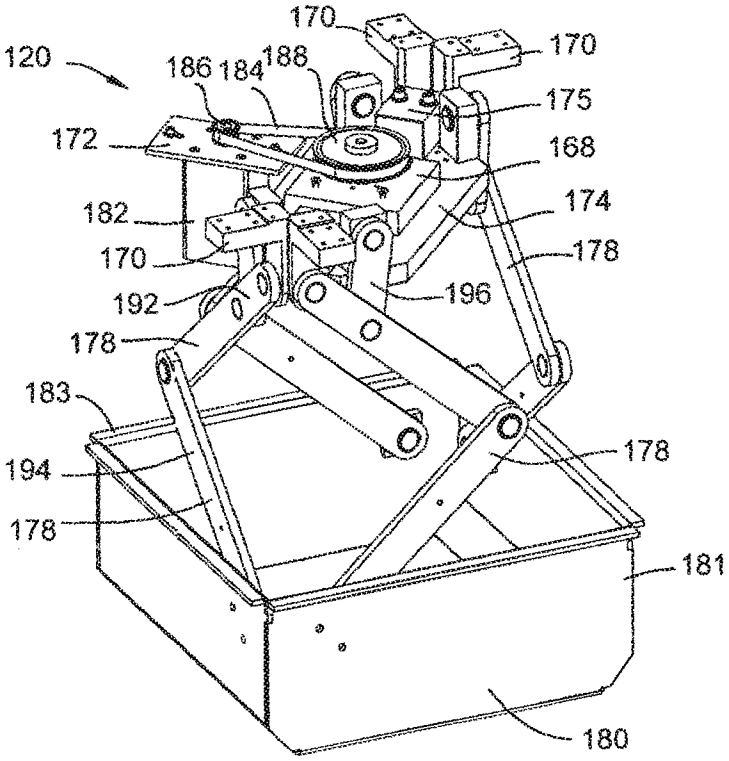
FIG. 12 is a perspective view of a trash compactor mechanism.
Figure 13:
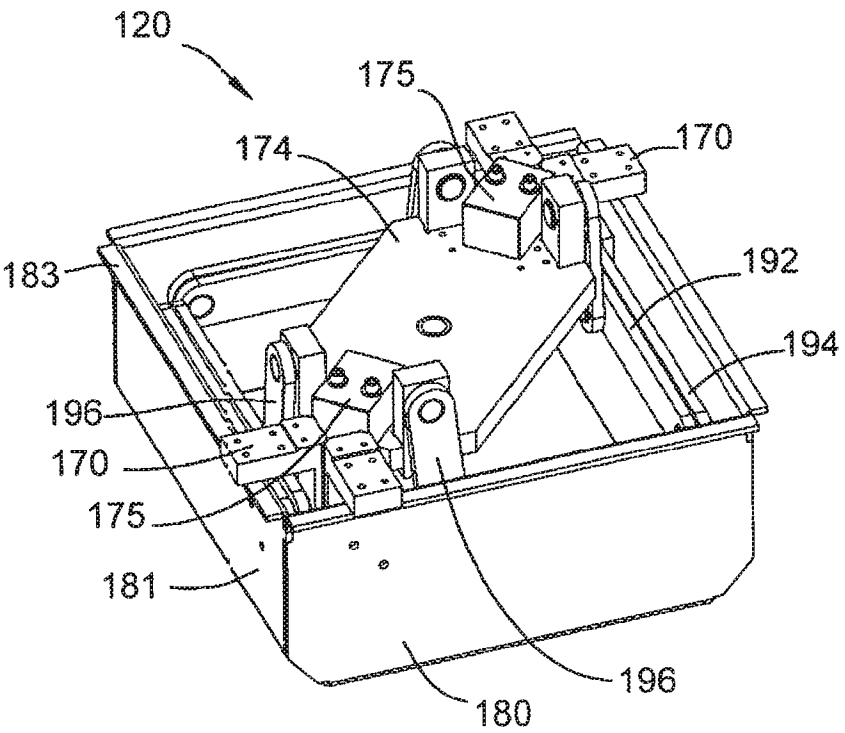
FIG. 13 is a perspective view of certain components of the trash compactor mechanism of FIG. 12.
Figure 14:
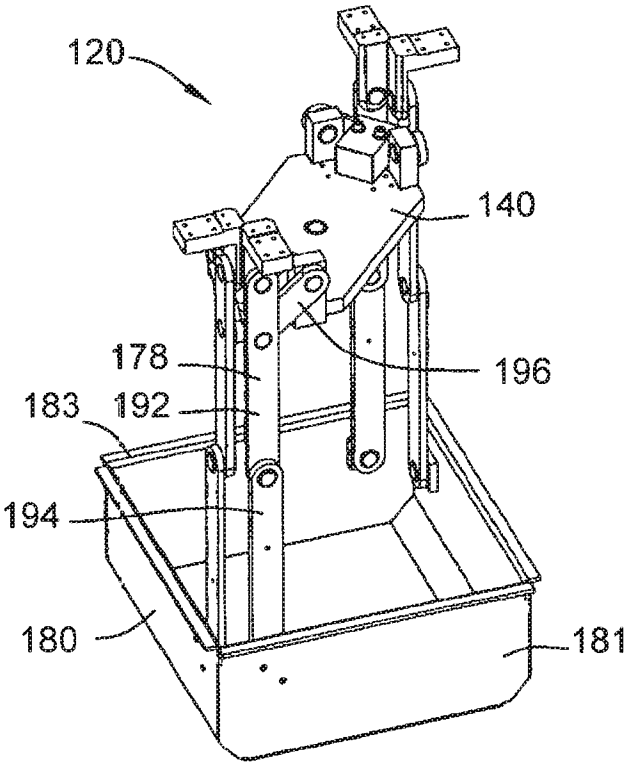
FIG. 14 is a perspective view of certain components of the trash compactor mechanism of FIG. 12.

Turning now to FIGS. 12, 13 and 14, the compacting mechanism 120 may be understood more fully. The general principle of operation may be seen by understanding which parts are fixed and which may move. FIGS. 12, 13 and 14 illustrate the compacting mechanism without the frame, to which screw actuator bracket 168, drive mechanism 172 and brackets 170 are attached. These parts are therefore fixed. Moving plate 174 moves up and down along the screw actuator, which rotates. This in turn, straightens and collapses linkages 178, which provides force to platen 180.

Platen 180 is a component with a generally flat bottom surface for compressing the trash into the trash receptacle and may include side walls 181 and upper lip 183 to align the platen within the trash receptacle and to prevent trash from accumulating on the platen. Preferably, the side walls are sized so that the upper lip is always above the trash receptacle. Ordinarily, when trash is being compressed in the trash receptacle, the side walls of the platen are at least partially disposed within the trash receptacle. This confines trash to the trash receptacle and prevents contamination of the compacting mechanism. Further, the upper lip, which extends outwardly from the side walls directs any potential spray of liquid trash away from the compacting mechanism.

It can be appreciated that the cross-sectional shape of the platen 180 and the cross-sectional shape of the trash receptacle should preferably correspond so that the platen is compressing the entire surface of the trash. A square or rectangular shape is the most efficient shape for the platen and the trash receptacle, though of course other shapes, such as circular or octagonal are within certain embodiments. The platen may also include a beveled front edge, which accommodates the opening of the inlet door. A chamfer on the rear edge may also be included. In embodiments that include a rear inlet door, this rear chamfer may accommodate the opening of the rear inlet door. These chamfers also aid in removing trash and add rigidity. In one contemplated embodiment, the platen may include chamfers around the circumference of the flat bottom surface. The flat bottom surface may also include ribs or ridges to create higher and lower pressure areas to better compress the trash.

The drive mechanism is an electric motor 182 connected to one end of the screw actuator by a pulley and belt system. Belt 184, drive pulley 186 and driven pulley 188 are shown. By selecting the electric motor and the diameter of the wheels, one can deliver a desired torque to the screw actuator at a desired rotational speed. This particular drive mechanism keeps the position of the compacting mechanism fixed even when power is turned off, except when the motor is operating, although other drive mechanisms may be used. The screw actuator is fixed vertically within the screw actuator plate and has the same axis of rotation as driven pulley 188 and is free to rotate about its vertical axis. As the screw actuator rotates, it drives the moving plate up and down. The screw actuator may be mounted in the moving plate by use of a floating bearing, which is free to rotate somewhat with respect to the drive plate. This floating bearing connection prevents unwanted forces from building up around the screw actuator. Further, there may be a position sensor on the moving plate to indicate when the plate is in the raised position.

The four linkages 178 are preferably generally symmetrically disposed about the two vertical planes, one between the first and second adjacent linkages and the third and fourth linkages and the other between the second and third adjacent linkages and the remaining two. As can be seen from FIG. 12, this arrangement provides that two of the linkages extend from one corner of the drive mechanism and the remaining two linkages extend from the opposite corner and that the linkages are fastened to the corresponding corners of the platen. Other than this arrangement, which balances forces on the drive mechanism and platen, the linkages of this embodiment are similar. For this reason, only one linkage will be discussed, although it should be understood that the discussion is applicable to each linkage. Linkage 178 has three components, upper linkage 192, lower linkage 194 and drive linkage 196. Upper linkage 192 has a first end connected to bracket 170 and a second end connected to lower linkage 194. Lower linkage 194 has a first end connected to the upper linkage and a second end connected to platen 180. Drive linkage has a first end connected to moving plate 174 and a second end connected to upper linkage 192 between the two ends of the upper linkage. Changing the length of the linkages and the connection position changes the force applied to the platen and the distance the platen may travel. In one embodiment, the linkages may not be completely retracted when the platen is in its highest position so that there is a slight angle between the upper and lower linkages.

The drive plate 174 may include guide blocks 175, which may be made from nylon or other suitable material. These guide blocks may help keep the lateral alignment of the drive plate. Another suitable alignment mechanism may be used as desired in place of or in addition to guide blocks 175.

In one embodiment, the moving plate travels for about 5 inches along the screw to produce about 28 inches of travel in the platen, and the compacting mechanism linkages can fit within an about 23 by about 23 inch square.

Each of the connections to the upper, lower and drive linkages allows one degree of rotational freedom. Such connections shall be referred to herein as simple hinge joints. Simple hinge joints can be formed between the linkages by using pins whose ends are captured using C-rings, by press-fitting a pin into one of the linkages and capturing the other end of the pin with a C-ring, or by some other suitable method. Other components such as roller or ball bearings may be included as well.

The four linkages 178 cooperatively stabilize and fix the position of platen 180. Because the linkages 178 are preferably symmetrical as described above, lateral forces on the plate are cancelled out. The compacting mechanism can thereby go from a fully raised position as shown in FIG. 13 to a fully extending position as shown in FIG. 14.

Of course, other compacting mechanisms operating on the same general principles are contemplated. For example, the compacting mechanism described above may have a moving plate that is raised or lower by a different mechanism than that of the screw actuator and drive mechanism described above, and the number and orientation of the linkages may be changed. For example, a ball actuator may be substituted for the screw actuator.

Figure 16:
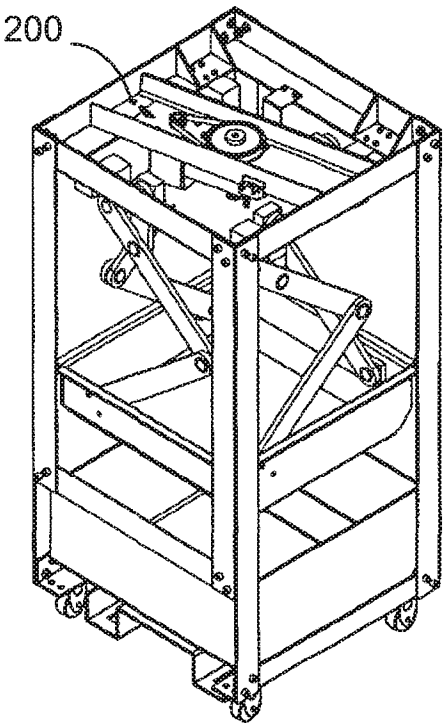
FIG. 16 is a perspective view of another embodiment of a trash compactor with certain components removed.
Figure 17:
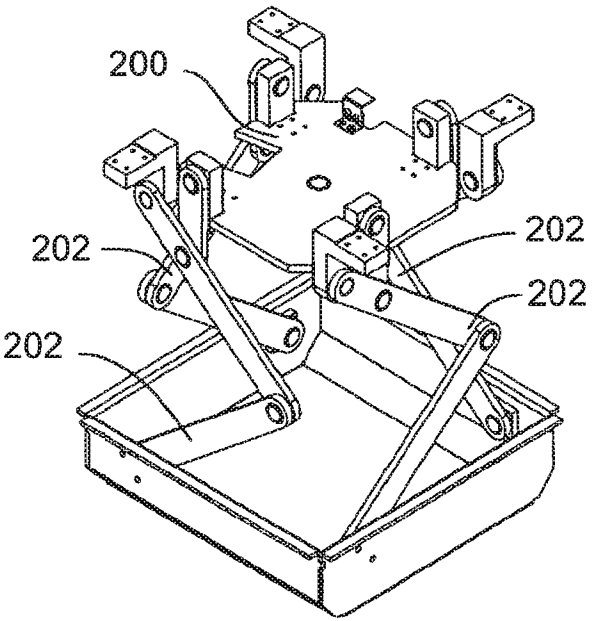
FIG. 17 is a perspective view of some of the compactor elements of the embodiment of FIG. 16.

Another alternative embodiment may be described with reference to FIGS. 16 and 17, which are partial views of a trash compactor illustrating a somewhat different drive mechanism 200, which operates according to the same general principals as described above, but in which linkages 202 are arranged symmetrically about the axis of the screw actuator. This embodiment illustrates that the linkages may be arranged in a wide variety of manners. For example, the linkages need not be symmetrically disposed nor do the linkages need to be at right angles to each other. Four linkages are shown both in this embodiment and in the previous embodiment but variations of any embodiment may include fewer or more linkages as preferred.

Figure 18:
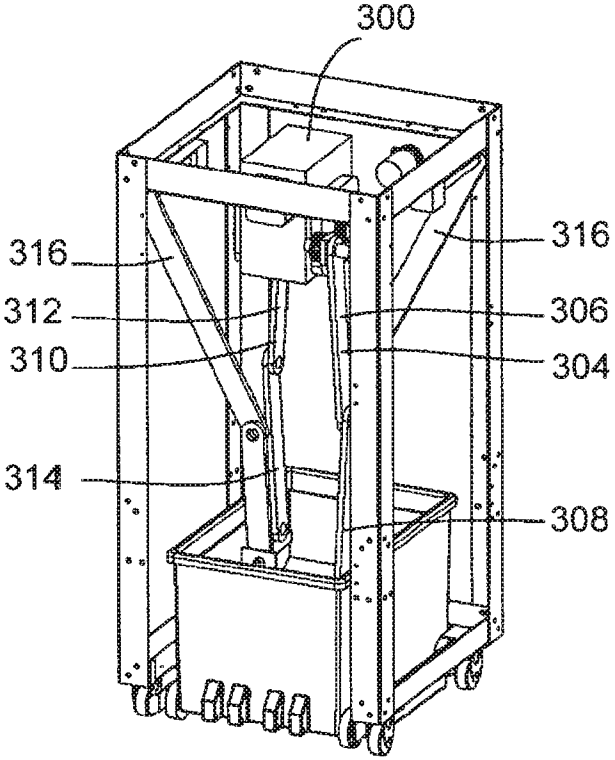
FIG. 18 is a perspective view of another embodiment of a trash compactor with certain components removed.
Figure 19:
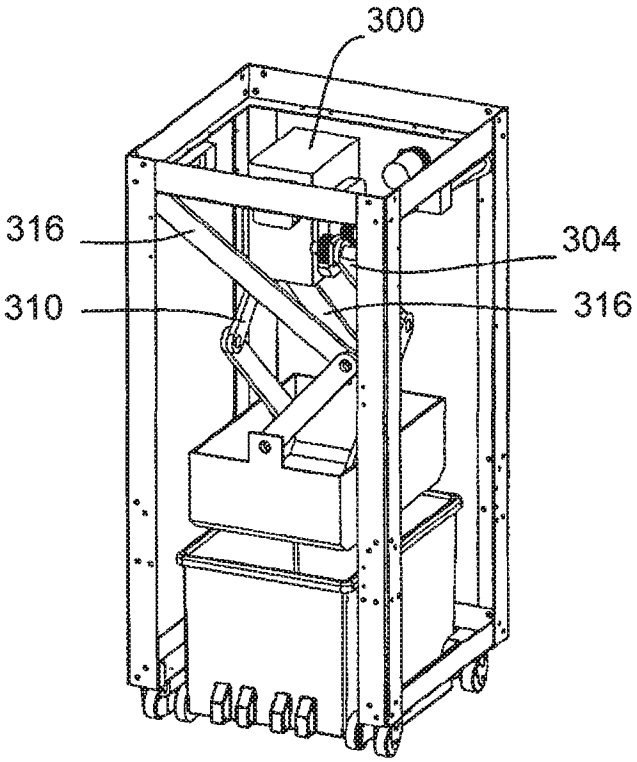
FIG. 19 is another perspective view of the embodiment of FIG. 18 with certain components removed.

Another alternative embodiment may be described with reference to FIGS. 18 and 19, which embodiment includes a drive mechanism 300 having an output that rotates horizontally. This output is connected to a linkage 304, via one or more gears as preferred. Linkage 304 has a drive arm 306 and a lower arm 308. Lower arm 308 is connected to the platen. A second linkage 310 may be attached to the other side of the drive mechanism and includes an upper arm 312 and a lower arm 314. Balance linkages 316 each include an upper arm and a lower and are attached to the frame and to the platen. The drive linkage provides the necessary force to the platen and the positioning of the four linkages ensures the platen is positioned correctly and securely. The arms of the linkages are connected using pins or other connections having one degree of rotational freedom.

This embodiment illustrates that the drive system and the guide linkage system need not be integrated as they are in the preceding two embodiments. The drive system may be any suitable drive system such as the drive screw systems described above, a geared system, a hydraulic system or the like. The guide linkage system generally includes at least two linkages, where each linkages operates in a plane and where the planes of at least two of the guide linkages intersect. The planes, for example, may be normal to each other.

A control system (not shown) controls the operation of the trash compactor. The control system can take inputs such as whether the inlet door is open, how many times the inlet door has been opened, the time since the last operation of the compacting mechanism, the current draw of the motor and so forth to operate the trash compactor. One possible mode of operation involves operating the compacting mechanism after the inlet door has been opened a predetermined number of times. For example, after the inlet door has been opened seven times, the control system locks the inlet door shut and operates the compacting mechanism. The stroke length of the platen may be determined by how many times the compacting mechanism has been operated since the liner to the trash receptacle has been last changed, it might be operated until a predetermined amount of force has been applied to the trash by the platen, or it might have a fixed length unless a predetermined force level has been exceeded. Other operating modes may be programmed as desired.

The compacting mechanisms described herein may be suitable for other uses than in a trash compactor. Any application where force is applied evenly over a surface may be suitable. For example, the compacting mechanism may be suitable for use in a machine press or a printing press.

Various embodiments of the invention have now been described in detail. Since changes, alterations and additions to the above described embodiments may be made without departing from the nature, spirit or scope of the invention, the invention is not to be limited to the embodiments described above, but rather the scope of the invention is defined only by the appended claims.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

We claim:

1. A trash compactor, comprising:

a frame defining a cavity, a receptacle configured for arrangement within the frame and to receive trash;

an upper linkage having a first end and a second end, the first end of said upper linkage attached to the frame by a first simple hinge joint, the first simple hinge joint having an axis of rotation;

a lower linkage having a first end and a second end, the first end of the lower linkage attached to the second end of the upper linkage by a second simple hinge joint;

a platen configured to move within the receptacle to compact the trash, the platen connected to the second end of said lower linkage by a third simple hinge joint; and a compacting mechanism configured to drive movement of the platen, the compacting mechanism having a secured end pivotally connected to said frame and a moving end vertically displaced from the secured end, the moving end pivotally connected to a linkage at a point between the first end of the upper linkage and the second end of the lower linkage, the compacting mechanism driving the platen by changing a distance between the secured end and the moving end thereby imparting motion to the upper linkage, the lower linkage, and the platen.

2. The trash compactor of claim 1, wherein the platen comprises a bottom surface and a sidewall extending from the bottom surface, the sidewall having an upper lip configured to align the platen with the receptacle.

3. The trash compactor of claim 2, wherein the upper lip extends away from central axis of the platen.

4. The trash compactor of claim 2, wherein the second end of the lower linkage is connected to the sidewall of the platen.

* * * * *